United States Patent [19]

Gutner et al.

[11] Patent Number: 4,501,453

[45] **Date of Patent: * Feb. 26, 1985**

[54] SLIDE ASSEMBLY FOR DRAWER

[75] Inventors: Kenneth H. Gutner, 3285 Dato, Highland Park, Ill. 60035; Jay S. Waxman, Skokie, Ill.

[73] Assignee: Kenneth H. Gutner, Highland Park, Ill.

[ * ] Notice: The portion of the term of this patent subsequent to Dec. 15, 1998 has been disclaimed.

[21] Appl. No.: 345,332

[22] Filed: Feb. 3, 1982

[51] Int. Cl.[3] ..... A47B 88/04

[52] U.S. Cl. ..... 308/3.6; 312/330 R; 312/341 NR

[58] Field of Search ..... 308/3.6, 3.8; 312/330 R, 342, 341 NR, 340, 343, 344, 345, 348

[56] References Cited

U.S. PATENT DOCUMENTS

| | | | |
|---|---|---|---|
| 3,375,051 | 3/1968 | Anderson | 312/330 R X |
| 4,108,520 | 8/1978 | Litchfield | 312/330 R |
| 4,305,625 | 12/1981 | Gutner et al. | 308/3.6 X |

*Primary Examiner*—Stuart S. Levy
*Assistant Examiner*—David Werner
*Attorney, Agent, or Firm*—Tilton, Fallon, Lungmus & Chestnut

[57] ABSTRACT

A drawer slide assembly for use with a generally T-shaped guide mounted on the article of furniture which includes a C-shaped slide mountable on the underside of a drawer receivable within the furniture article, the slide being equipped with an interlocking plastic element.

10 Claims, 6 Drawing Figures

FIG. 3
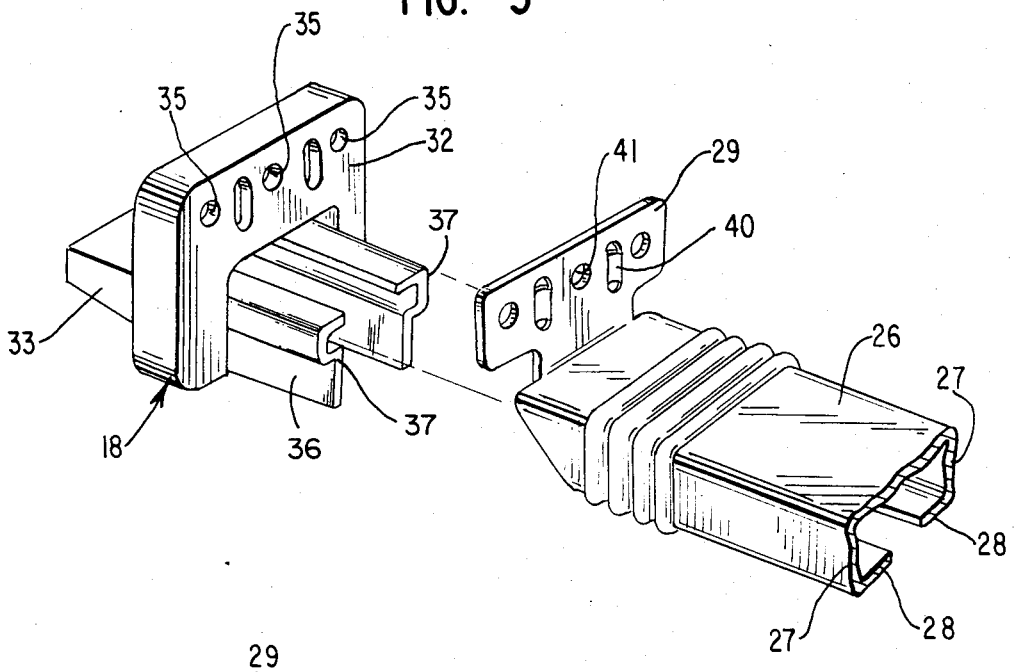
FIG. 4
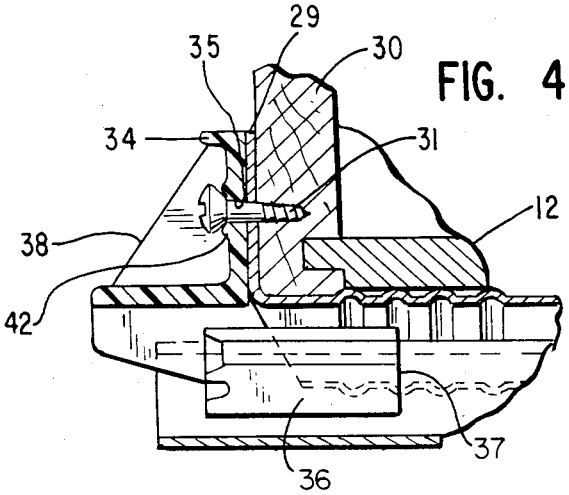
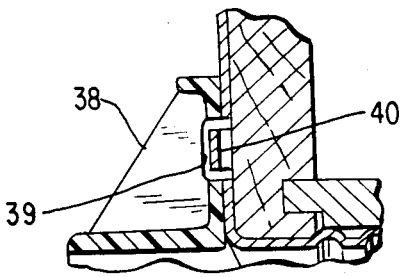
FIG. 5
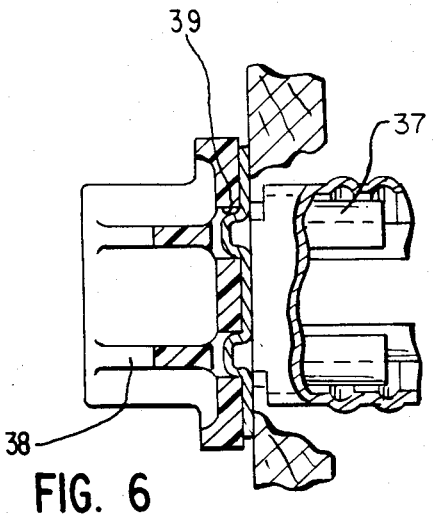
FIG. 6

SLIDE ASSEMBLY FOR DRAWER

BACKGROUND AND SUMMARY OF INVENTION

This invention relates to a drawer slide assembly and, more particularly, to an interlocking assembly including a C-shaped metal slide and a plastic bearing element, the assembly being used in connection with a T-shaped guide installed on a dresser or the like.

In our earlier U.S. Pat. No. 4,305,625, a novel drawer slide and guide assembly was disclosed which made use of plastic slide and guide bearing elements in conjunction with metal members to develop reliable, trouble-free operation while minimizing the cost. In particular, the plastic elements which constituted the means for avoiding metal to metal contact not only avoided irritating noise but also developed a smoother sliding action.

In the practice of the invention of the above-identified patent, we have discovered improvements which facilitate both the assembly and operation. Through the use of cooperating detent and recess means on the elements making up the slide, the assembly has been materially improved both insofar as time and accuracy are concerned. Also through the use of annular shoulders about the opening securing the plastic bearing fitting and slide member tab to the rear panel of the drawer, advantages and economies in installation and operation are also attained.

Other objects and advantages of the invention may be seen in the details of the ensuing specification.

DETAILED DESCRIPTION

The invention is described in conjunction with the accompanying drawing, in which FIG. 1 is a fragmentary exploded perspective view of an article of furniture equipped with one version of the inventive slide assembly;

FIG. 3 is a view similar to FIG. 2 but viewed the opposite way; and

Figure 2:
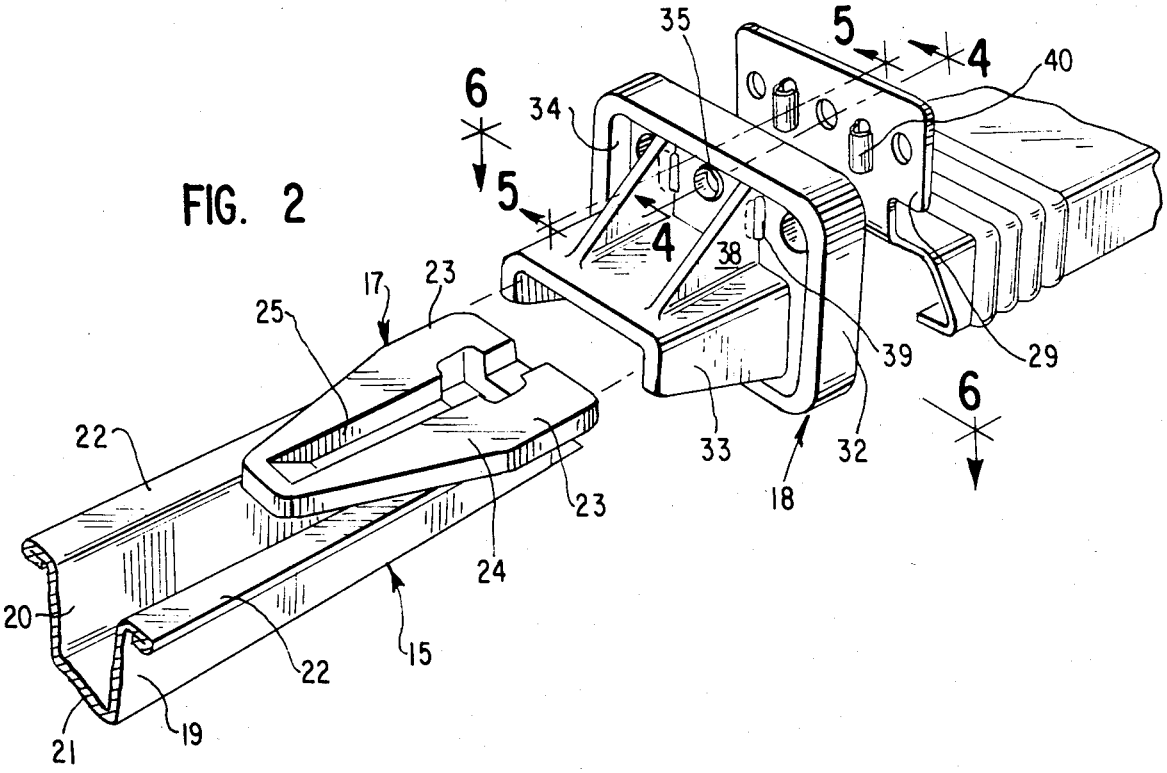
FIG. 2 is a fragmentary perspective view of the slide and guide members in exploded relation.

FIGS. 4, 5 and 6 are sectional views along the sight lines 4—4, 5—5 and 6—6, respectively, of FIG. 2.

Figure 1:
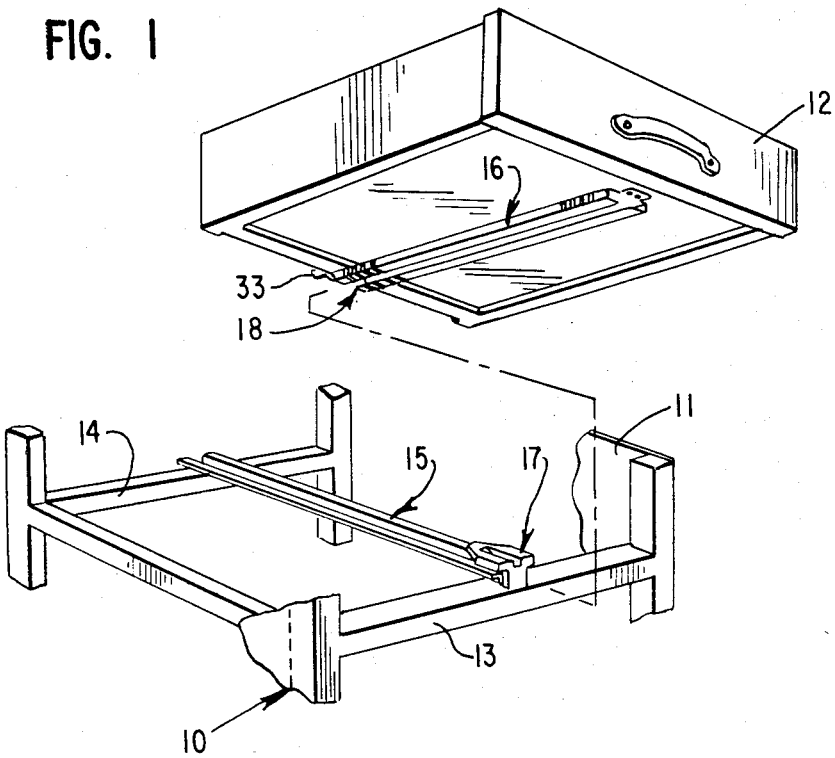

In the illustration given, and with reference first to FIG. 1, the numeral 10 designates generally an article of furniture—such as a dresser—which is equipped with a front opening 11 for the receipt of a drawer 12. The bottom portion of the opening 11 is defined by a front parting rail 13 which is aligned with the usual rear parting rail 14 for the support of a generally T-shaped guide member which herein is generally represented by the numeral 15. Thus, the guide 15 is the stationary member which cooperates to guide the sliding member generally designated 16 and which is affixed to the underside of the drawer 12.

Still referring to FIG. 1, the numeral 17 designates a plastic element rotatably supported adjacent the front end of the guide 15 and which provides a bearing surface between the guide 15 and the slide 16. At the rear thereof, the slide 16 is equipped with a plastic adapter 18 (better seen in FIGS. 2 and 3) and which provides a second bearing between the guide 15 and the slide 16. As was brought out in greater detail in the above-identified patent, the plastic element 17 on the T-shaped guide and the plastic adapter element 18 on the C-shaped slide provide bearing supports to substantially avoid noise from metal to metal bearing contact while simultaneously providing a lubricating effect.

Guide Construction

Reference is now made to FIG. 2 which shows the generally T-shaped guide 15. The stem portion of the T-shape is provided by vertically extending spaced apart walls 19 and 20 connected at their bottom ends by a cross wall 21. At the upper ends of the walls 19 and 20, the metal thereof is deformed sidewardly and outwardly to form flanges as at 22 and which define wings of the cross of the T-shape.

The plastic element 17 can also be seen in FIG. 2 and includes a unitary block equipped with horizontally extending integral flanges 23. The block is press-fitted between the walls 19 and 20. The flanges 23 extend parallel to the wings 22 but are spaced thereabove. The top surface 24 is recessed at 25 to accommodate a woodscrew for securing the guide 15 to the parting rail 13 and to permit passage of the slide detent for drawer removal.

Slide Construction

The C-shaped slide 16 has an upper transverse wall or bight portion 26 merging into depending arms 27 which in turn are equipped with integral inwardly extending flanges 28 (see FIG. 3). The extreme rear end of the slide 16 is equipped with an upstanding tab 29—see FIG. 3. This serves to secure the slide 16 to the rear wall 30 of the drawer 12 by means of woodscrews 31 (see FIG. 4)—these also serve to secure the plastic adapter 18 to the drawer 12 (see FIG. 3). The other ends of the slide 16 and guide 15 are secured in conventional fashion to the drawer 12 and rear parting rail 14, respectively.

The construction of the adapter 18 can be best appreciated from a consideration of FIGS. 2 and 3. The plastic adapter element 18 is provided in the form of a unitary piece. Essentially, it is horizontally elongated with an upstanding central flange as at 32. On the rear side of the flange 32, the element 18 is equipped with a generally inverted U-shaped projection 33 (see FIG. 2). This is shaped to receive and pass the flanges 23 of the plastic element 17. The wall-like flange 32 is rigidified by a partial perimetric flange or shoulder 34 (see FIG. 2). The flange 32 is apertured as at 35 for the receipt of the woodscrews 31 as seen in FIG. 4.

Extending forwardly from the flange 32 is the portion 36 (see FIG. 3) of the adapter 18 which receives in sliding relationship the wings 22 of the guide 15 (see FIG. 2). As can be appreciated from a consideration of FIG. 3, the portion 36 includes opposed ways as at 37 which are essentially question-mark in shape. The ways 37 provide horizontally extending surfaces for contact with the wings 22. Extending between the wall-like flange 32 and the rearwardly extending portion 33 are a pair of ribs 38 (compare FIGS. 2 and 4).

In alignment with the ribs 38, the wall-like flange 32 is slotted as at 39—see FIGS. 2, 5 and 6. The ribs 38 and therefore the slots 39 flank the central of the openings 35—so indicated in FIG. 2.

Provided in alignment with the slots 39 are detent means 40 in the tab 29. These likewise flank the central opening 41 (see FIG. 3) in the tab 29. The detent means 40 are advantageously achieved by striking or upsetting metal from the essential planar tab 29 so as to develop protrusions which are press-fitted into the recesses 39. This makes possible the setting up of the work during installation with a minimum of clamping or other manual handling. The openings 35 and 41 are thereby aligned so that the installation of the woodscrew 31 into the rear panel 30 of the drawer 12 is substantially simplified. In addition, with the holding power developed by the cooperation of the detent means 40 and recesses 39, only a single woodscrew 31 need be used. Other screws may be used as well as staples and the like.

Additional advantages in installation are provided through the installation of annular shoulders as at 42 (see FIG. 4) on the rear side of the opening 35. This provides a passage or opening of substantial length so that the woodscrew 31 can be self supporting prior to being driven home into the rear panel 30. Advantageously, the annular shoulder 42 is developed during molding and is thus integral with the wall-like flange 32.

While in the foregoing specification a detailed description of an embodiment of the invention has been set down for the purpose of illustration, many variations in the details hereingiven may be made by those skilled in the art without departing from the spirit and scope of the invention.

We claim:

1. A slide assembly for a drawer adapted to cooperate with a generally T-shaped guide on a dresser or the like comprising a metal slide member having a generally C-shape in transverse section extending over a major portion of its length to cooperate with said guide, said member at one end thereof being equipped with an integral upstanding tab adapted to be secured to the back panel of a drawer, said tab having an opening therethrough positioned centrally thereof, said opening being flanked by a pair of detent means, said slide assembly also including a plastic adapter element adjacent said one end and shaped also to cooperate with said guide, said adapter element having an integral bearing portion adapted to be received within said slide member C-shape and having an integral upstanding flange adapted to abut said tab, said flange being equipped with a central opening alignable with said tab central opening when said bearing portion is received within said C-shape for the joint receipt of a back panel securing screw, said flange also being equipped with a pair of slots alignable with said detent means.

2. The structure of claim 1 in which said adapter element has a pair of vertically extending ribs flanking said opening and in alignment with said slots.

3. The structure of claim 2 in which said slots extend through said flange, said ribs serving to stabilize and rigidify said flange about said slots.

4. The structure of claim 3 in which said slots are vertically elongated.

5. The structure of claim 1 in which said detent means are integral projections struck from said tab.

6. The structure of claim 5 in which said detent means are vertically elongated.

7. The structure of claim 1 in which said flange central opening is equipped with an annular shoulder projecting rearwardly from said flange.

8. A slide assembly for a drawer comprising an elongated generally C-shaped member in transverse section having an upstanding tab at the rear end thereof, said tab being planar and adapted to abut the rear panel of a drawer, a plastic bearing element slidably received within the rear portion of said slide member and having an upstanding wall-like flange abutting said tab, aligned openings in the central portions of said flange and tab for the receipt of a securing screw, vertically elongated slot and detent means in said flange and tab, respectively for cooperative action in maintaining the adapter element and slide member in assembled form during installation and thereafter providing stabilization for the assembly.

9. The structure of claim 8 in which said adapter element is equipped with vertical ribs in alignment with the slits thereof.

10. The structure of claim 9 in which said flange opening on the rear side thereof is equipped with an annular outstanding shoulder to provide support for said screw during installation.

* * * * *